US005512143A

United States Patent [19]

Keating

[11] Patent Number: 5,512,143

[45] Date of Patent: Apr. 30, 1996

[54] ELECTROLYSIS METHOD USING POLYMER ADDITIVE FOR MEMBRANE CELL OPERATION WHERE THE POLYMER ADDITIVE IS IONOMERIC AND ADDED TO THE CATHOLYTE

[75] Inventor: James T. Keating, Wilmington, Del.

[73] Assignee: E. I. Du Pont de Nemours and Company, Wilmington, Del.

[21] Appl. No.: 867,494

[22] Filed: Apr. 13, 1992

[51] Int. Cl.$^6$ ..... C25B 1/16

[52] U.S. Cl. ..... 205/512; 205/517; 205/521

[58] Field of Search ..... 204/98, 128; 521/25, 521/27, 28; C25B 1/16, 15/00, 15/02

[56] References Cited

U.S. PATENT DOCUMENTS

| | | | |
|---|---|---|---|
| 3,793,163 | 2/1974 | Dotson | 204/98 |
| 4,105,516 | 8/1978 | Martinsons et al. | 204/98 |
| 4,174,266 | 11/1979 | Jeffery | 204/98 |
| 4,337,127 | 6/1982 | Copeland | 204/98 |
| 4,453,991 | 6/1984 | Grot | 427/140 |

FOREIGN PATENT DOCUMENTS

| | | |
|---|---|---|
| 54-99797 | 1/1978 | Japan . |

*Primary Examiner*—Kathryn Gorgos
*Attorney, Agent, or Firm*—John S. Hendrickson

[57] ABSTRACT

The operation of electrolytic cells employing ion exchange membranes is improved by addition to the catholyte of a fluorinated ionomer resin resulting in a long-term reduction in the operating voltage of the electrolytic cell.

11 Claims, 3 Drawing Sheets

ELECTROLYSIS METHOD USING POLYMER ADDITIVE FOR MEMBRANE CELL OPERATION WHERE THE POLYMER ADDITIVE IS IONOMERIC AND ADDED TO THE CATHOLYTE

FIELD OF THE INVENTION

This invention is concerned with addition of fluorinated ionomer resins to the catholyte in an electrolytic cell resulting in long-term reductions in cell voltage.

BACKGROUND OF THE INVENTION

The state-of-the-art method for electrolyzing an alkali metal halide, especially sodium chloride (NaCl) or potassium chloride (KCl), is to use a fluorinated ionomer membrane to separate the anolyte and catholyte compartments of an electrolytic cell. The membrane permits the alkali metal cations to pass through to the catholyte, but severely restricts the undesirable passage of hydroxyl ion from the catholyte to the anolyte. To make membrane electrolysis attractive, the power consumption should be minimized, which means that the current efficiency should be maximized and the cell voltage (or resistance) should be minimized.

Many efforts have been made to improve the performance of electrolytic cells and fluorinated ionomer membranes by a wide variety of treatments. Many of them have been aimed at higher current efficiency and lower power consumption. However, it is also desirable to obtain lower voltage. Any voltage over that needed to electrolyze brine is lost as heat and represents a waste of electric power. Excessive heat production can limit electrolyzer productivity by raising cell temperatures and increasing gas volume. Also, the rectifiers used in chloralkali plants are rated for power, which is the product of voltage and amperage. At higher voltages, less amperage can be supplied, reducing the productivity of the electrolyzers.

The art which is believed to be closest to the present invention is in Japanese Patent Application Publication 554-99797 (Toshio Oku, et al., Tokoyama Soda Company, Ltd.). These inventors reduced cell voltage by adding a water soluble substance of at least 100 molecular weight to the catholyte. The water soluble substances described in the application include polyvinyl alcohol, polyether, surfactant, gelatin, water-soluble cellulose, sugars and agars, which are present in the catholyte chamber at an effective concentration not exceeding 1%, preferably 10–100 ppm. The inventors indicate that they believe that the cell voltage is reduced because the state of foam inside the cathode chamber is altered, changing from a turbid suspension containing hydrogen gas to separate phases, one being a foam of relatively large particle size and the other being a clear liquid. However, the additive can be degraded by the reactants and must be continuously or frequently added to the cathode chamber to achieve the desired reduction in cell voltage. Furthermore, the additive does not result in a permanent membrane treatment which can survive harsh electrolysis conditions, including shutdown and start-up of the electrolytic cell, and storage of the membrane.

SUMMARY OF THE INVENTION

In the present invention, fluorinated ionomer resins or a solution or dispersion of fluorinated ionomer resin is added to the catholyte to reduce voltage during the electrolysis of alkali metal halide solutions. The resin is, preferably, a fluorinated sulfonyl resin which is suspended in the catholyte. It has been found that the addition of a 0.001–0.1% (by weight) aqueous or alcoholic solution or dispersion of resin in the cathode chamber in an amount of about 10 ml–1000 ml per square meter of ion exchange membrane reduces cell voltage by about 0.02–0.2 V, resulting in a permanent decrease in power consumption of the electrolytic cell by 1–5%. The fluorinated ionomer resin may also be applied to the cathode side of the membrane prior to installation in the electrolytic cell. The addition of the fluorinated ionomer resin results in a permanent improvement to the membrane, capable of surviving harsh electrolysis conditions and storage of the membrane.

The process of the invention is quite useful in producing sodium hydroxide (NaOH) in the range of 10–40 weight percent, particularly in the present commercial range of 32–36 weight percent, providing lower voltage and lower power consumption.

DETAILED DESCRIPTION OF THE INVENTION

Figure 1:
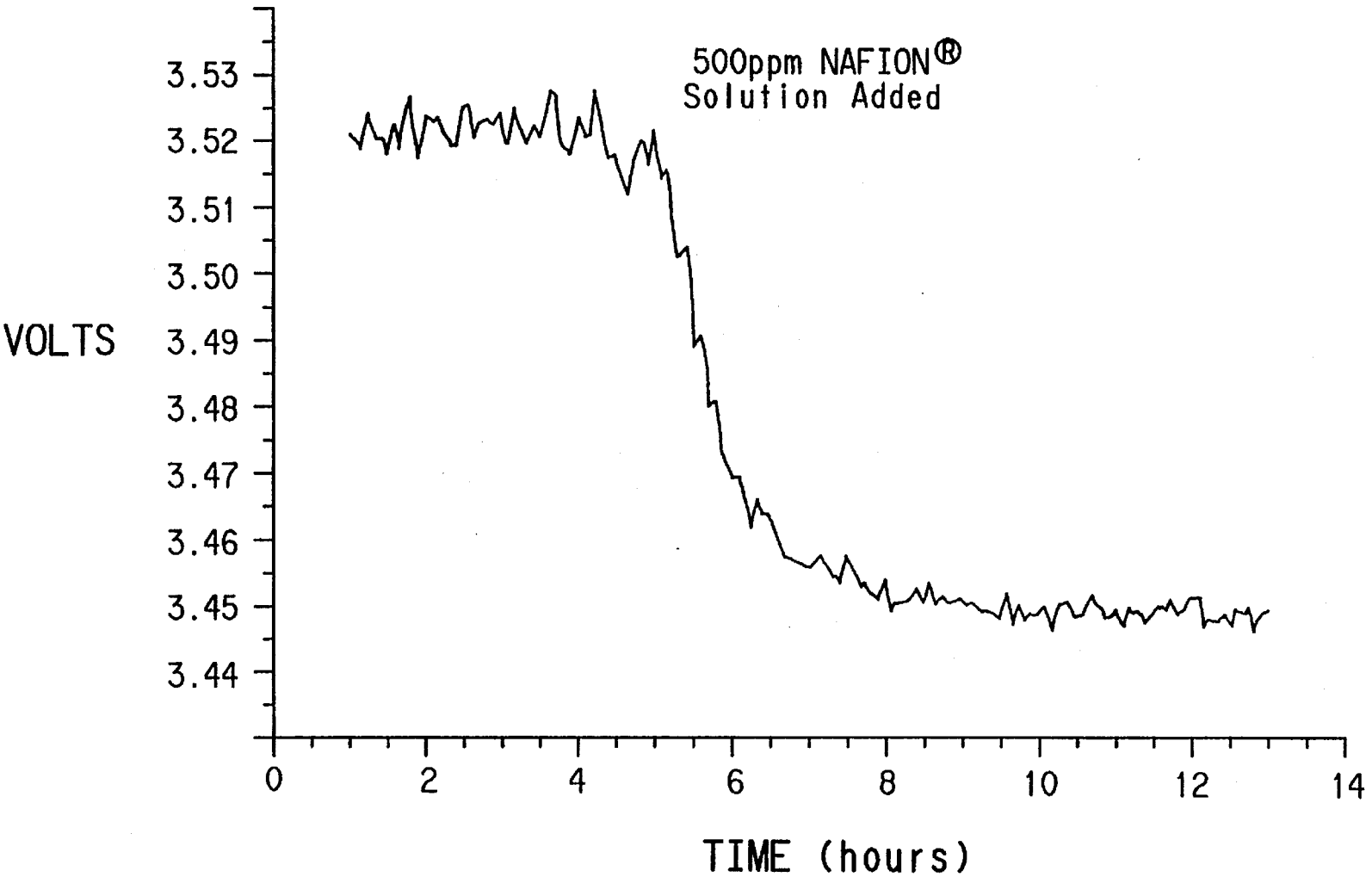
FIGS. 1 and 2 plot cell voltage in volts vs. time showing the reduction in voltage following the addition of fluorinated ionomer resin, described in Examples 1 and 2, respectively.

The invention is a method of electrolyzing solutions, particularly aqueous alkali metal chlorides, in which an electric potential is imposed across an anode and a cathode so that an electric current passes from an anode of an electrolytic cell to a cathode of the cell. In chloralkali electrolysis, chlorine is evolved at the anode and hydrogen is evolved at the cathode. According to the present invention, a fluorinated ionomer resin, preferably a fluorinated sulfonic acid resin is added to the catholyte liquor, or applied to the cathode side of the ion exchange membrane prior to installation in the electrolytic cell.

The invention is useful for any electrolysis utilizing a fluorine containing ion exchange membrane where improved wettability of the membrane would be beneficial. For example, in the commercial electrolysis of alkali metal chlorides to yield chlorine, hydrogen, and an alkali metal hydroxide, the alkali metal chloride may be sodium chloride or potassium chloride. Most commonly, the alkali metal chloride is sodium chloride and the invention will be described with respect to sodium chloride and sodium hydroxide. However, it is to be understood that the method of this invention is equally useful with potassium chloride brines or other alkali metal salt solutions such as sodium carbonate, sodium bicarbonate and sodium sulfate solutions.

According to the present invention, the fluorinated ionomer resin is added to the catholyte liquor while an electric current is applied to the electrolytic cell. Thereafter, the cell voltage is found to be reduced, for example, from about 3.60 volts to 3.40 volts. The exact mechanism for attaining this voltage reduction is not clearly understood but is believed that the fluorinated ionomer resin is coating the catholyte surface of the ion exchange membrane, thereby making it more wettable. The fluorinated resin is anionic and is attracted by the electric field to the catholyte surface of the ion exchange membrane. It is believed that some of the resin sticks to the surface of the membrane. If the ion exchange membrane is not wetted by electrolyte, gas locking occurs reducing the effectiveness of the membrane, ultimately leading to an increase in operating voltage of the electrolytic cell. In particular, if the membrane is not fully wetted, gas bubbles generated at the electrode will accumulate on the surface of the membrane, blocking ion flow. This reduces the effective membrane area, leading to an increase in voltage and eventually causing premature shutdown of the electrolytic cell.

The particular fluorinated ionomer resin which may be added to the catholytic according to this invention is a resin which is highly fluorinated, which means that at least 90%, preferably at least 95%, and most preferably, all of the atoms attached to the carbons are fluorine atoms or fluorinated side-chain ether groups, which may contain functional groups hydrolizable to salts. The non-fluorine atoms, if used, may be hydrogen, chlorine or bromine. Preferred polymers which may be added to the catholyte according to the present invention are polymers with side chains containing the group $—CF_2CFR'SO_2X$, wherein R' is F, $ClCF_2Cl$ or a $C_1$ to $C_{10}$ perfluoroalkyl radical, and X is F or Cl, preferably F. Ordinarily, the side chains will contain $—OCF_2CF_2CF_2SO_2X$ or $—OCF_2CF_2SO_2F$ groups, preferably the latter. The perfluorinated polymers are especially preferred.

Polymers containing the side chain $$—O(CF_2\underset{\underset{CF_3}{|}}{C}FO)_k—(CF_2)_j—SO_2F \quad ,$$

where k is 0 or 1, preferably 1, and j is 1–5, preferably 2, may be used. These polymers are among the same polymers that are used to fabricate the ion exchange membrane.

This group of fluorinated ion exchange resins is substantially resistant to degradation by or reaction with the catholyte liquor. In addition, the products of any decomposition are tolerable in the electrolyte and, contrary to prior art processes, do not add any commercially or environmentally undesirable impurity to the electrolyte or the product.

There is no rigid specification regarding the method of addition of the fluorinated ionomer resin, so long as the amount is sufficient to reduce the voltage in the electrolytic cell.

It is also possible to add the resin, in batch, continuously or intermittently to the cathode compartment. It is preferable to add 1–1000 ml of fluorinated ionomer resin solution having a concentration of 0.001–1% for each square meter of membrane in the electrolytic cell. Excess addition of ionomer of the electrolyzer is not harmful, but being wasteful, should be avoided. The solution can be metered into the catholyte dilution water or circulating catholyte over several minutes to hours. As a practical matter, a slow addition of dilute solution is desirable to minimize the quantity added. Slow addition of the solution is continued until cell voltage declines to a stable value. The effectiveness of the additive introduced into the cathode compartment remains for some time even after the catholyte has been completely removed. As noted above, it is believed that the fluorinated ionomer resin coats the catholyte surface of the ion exchange membrane. Thus, a one-time addition of the additive will permanently accomplish the desired voltage reduction. It has been found that the addition of the fluorinated ionomer resin reduces cell voltage even after cell shutdowns. The voltage reduction also persists after the membrane has been removed, allowed to dry, stored for several months and then reinstalled in the cell. If impurities accumulate in the cell and raise voltage during cell operation, it may be useful to add more ionomer from time to time to see if the voltage rise can be counteracted.

The resin may be added to the catholyte liquor with a liquid medium such as water, caustic, alcohol, or other liquid. A solution of the resin may be made according to the processes described in U.S. Pat. Nos. 4,433,082 and 4,453,991. Preferably, the liquid medium does not react with the cathode and does not impair the current efficiency or voltage of the cell. In practice, the resin is suspended or dispersed in the liquid medium and some or all remains suspended after being added to the catholyte.

Although infinitesimal amounts of resin may reduce cell voltage, the preferred amount of resin solution is 1–1000 ml of resin solution having a concentration of 0.001 to 1% per square meter of membrane.

Although the invention is applicable over a wide range of cell operating conditions, it ordinarily finds greatest use in cells operating at a current density of 1–6 kA/sq. m. at 40°–95° C., while producing caustic at a concentration of about 28–36% by weight, with an exit brine concentration of about 150–280 g/l brine.

This invention is useful broadly in the chloralkali industry for providing a more efficient and economical operation of chloralkali cells. For example, for a plant producing 1,000 metric tons of caustic per day, operating at 95% current efficiency with power costs of $0.03/kWh, there is an annual saving of $750,000 per year for each reduction in operating voltage of 0.1 volts. Beyond the actual monetary savings there is a corresponding saving in the world's energy reserves.

The membranes used in this invention and methods of fabrication are well-known. The membranes are fluorinated, which means that at least 90%, preferably at least 95%, and most preferably all of the atoms attached to the carbons are F atoms or side-chain ether groups, which may contain functional groups hydrolyzable to salts. The non-fluorine atoms, if used, may be H, Cl, or Br.

Preferably, the membrane used in the electrolytic cells according to the process of this invention consists of at least two layers, at least the one layer in contact with the anolyte having pendant sulfonyl groups. Generally, there is at least one layer of the membrane also formed from polymer having a carboxyl group.

The copolymers used in the manufacture of membrane layers used in the process of the present invention should be of high enough molecular weight to produce films which are self-supporting in both their melt-fabricable (precursor) form and in the hydrolyzed ion exchange form.

A membrane having at least one layer of a copolymer having sulfonyl groups in melt-fabricable form and a layer of a copolymer having carboxyl group in melt-fabricable form, such as made by coextrusion, can be used as one of the component films in making, by hydrolysis, the membrane to be used in the process of the present invention. Such a laminated structure will be occasionally referred to herein as a bimembrane. Bimembranes are well known in the art.

It is in fact preferred to use in the present process a carboxylate/sulfonate bimembrane. It is also possible to use an all-carboxylate membrane with a layer of lower equivalent weight on the anolyte side.

The membrane used in this invention may also comprise three layers:

a) on the catholyte side, a carboxylate layer of a 5–50 micrometer thickness, preferably 20–40 micrometers, with an equivalent weight suitable to provide a water transport of 2.0–4.0 moles of water per gram-atom of Na, b) in the middle, an optional carboxylate layer with a lower equivalent weight and a thickness in the same range, as that of (a), and c) on the anolyte side, a sulfonate layer of a 25–250 micrometer thickness, preferably 75–100 micrometers.

Membranes usually have an overall thickness of 50–300 micrometers, especially 125–200 micrometers.

The customary way to specify the structural composition of films or membranes in this field is to specify the polymer composition, ion-exchange capacity or equivalent weight, and thickness of the polymer films in melt-fabricable form, from which the membrane is fabricated. This is done because the measured thickness varies depending on whether the membrane is dry or swollen with water or an electrolyte, and even on the ionic species and ionic strength of the electrolyte, even though the amount of polymer remains constant.

For use in electrolysis of brine, the membrane should have all of the functional groups converted to ionizable functional groups which is ordinarily and conveniently accomplished by hydrolysis with acid or base. These will be sulfonate and carboxylate groups, preferably the sodium or potassium salts thereof.

The equivalent weight desired is not critical, and depends somewhat on the structure of the salt-containing side chain on each polymer. It may be obtained by using a mole ratio of tetrafluoroethylene to the comonomer in the carboxylate copolymer of 4.0–8.2, preferably 6.0–7.4.

The equivalent weight of the sulfonate polymer is even less critical. It should be low enough to give low membrane resistance (low electrolysis voltage), but not so low as to give a membrane which is too soft or sticky when wet for convenient handling and installation in a cell.

The membrane may be unreinforced film or bifilm, but for dimensional stability and greater notched tear resistance, it is common to use a reinforcing material. It is customary to use a fabric made of a fluorocarbon resin such as polytetrafluoroethylene or a melt-processable copolymer of tetrafluoroethylene with hexafluoropropylene or with perfluoro(propyl vinyl ether). These may be woven into fabric using various weaves, such as the plain weave, basket weave, leno weave, or others. Relatively open weaves are preferred because the electric resistance is lower. A porous sheet may be used as a support. Other perhalogenated polymers such as polychlorotrifluoroethylene may also be used, but perfluorinated supports have the best resistance to heat and chemicals. The fibers used in the support fabrics may be monofilaments or multifilament yarns. They may be of ordinary round cross-section or may have specialized cross-sections. Oblong or rectangular cross-sections, if suitably oriented to the membrane, make it possible to get more reinforcing action with a thinner overall membrane. It may be desirable to use sacrificial fibers such as rayon, paper, or polyester, along with the fluorocarbon fibers. Care should be taken, however, not to have the soluble or degradable fibers extend from one surface to the other lest the nonporous membrane become a porous diaphragm, and the caustic product contain too much salt. Even with a cloth or mesh of fluorocarbon fibers, it is preferred not to have the cloth penetrate the surface of the membrane on the cathode side. The fabric employed may be calendered before lamination to reduce its thickness. In a bimembrane, the fabric may be in the sulfonate or carboxylate layer, or in both, but is more often in the sulfonate layer, which is usually thicker. In place of fabric, fibrils can be used.

The membrane or bimembrane may be used flat in various known filter press cells, or may be shaped around an electrode. The latter is especially useful when it is desired to convert an existing diaphragm cell to a membrane cell in order to make higher quality caustic.

Membranes can be swelled with polar solvents (such as lower alcohols or esters, tetrahydrofuran, or chloroform) and then dried, preferably between flat plates, to improve their electrolytic performance. Before mounting in commercial cell support frames, which may be 1–5 meters on a side, the membrane can be swelled so that it will not wrinkle after it is clamped in the frame and exposed to electrolytic fluids. Among the swelling agents that can be used are water, brine, sodium bicarbonate solution, caustic, lower alcohols, glycols, or mixtures thereof.

The cell can have two or three compartments, or even more. If three or more compartments are used, the membrane is commonly placed next to the cathode compartment, and the other dividers may be porous diaphragms or membranes. The cells may be connected in series (so-called bipolar cells) or in parallel (so-called monopolar cells). The membrane may be disposed horizontally or vertically in the cell, or at any angle from the vertical.

Any of the conventional electrodes or electrode configurations may be used. The anode should be resistant to corrosion by brine and chlorine and to erosion and preferably should contain an electrocatalyst to minimize chlorine overvoltage. A commercially available anode known as dimensionally stable anode (or DSA) is one of those that are suitable. A suitable base metal is titanium, and the electrocatalysts include reduced platinum group metal oxides (such as Ru and the like), singly or in mixtures, optionally admixed with a reduced oxide of Ti, Ta, Nb, Zr, Hf, V, Pt, or Ir. The electrocatalysts may be heat-treated for stability.

The anode may be a "zero-gap" anode, against which the membrane is urged and which anode is permeable to both liquids and gases. The anode may be kept a small distance from the membrane by the use of a spacer, against which the membrane is urged by a small hydraulic head on the other side of the membrane. The spacer may be made of a plastic which is resistant to the chemicals in the anolyte, such as polytetrafluoroethylene or polychlorotrifluoroethylene. It is desirable that the spacer or the electrode have open vertical channels or grooves to facilitate the escape of gas evolved at the anode. Whether or not there is a spacer, it may be desirable to have the anode openings slanted, so that the gas is carried away from the membrane, and anolyte circulation past the membrane is maximized. This effect can be augmented by using downcomers for anolyte which has been lifted by the rising gas bubbles. The anode may be a screen or perforated plate or powder which is partially embedded in the anode surface layer of the bimembrane. In this case, the current may be supplied to the anode by current distributors which contact the anode at numerous closely-spaced points. The anode may be a porous catalytic anode attached to or pressed against the membrane or attached to or pressed against a porous layer, which is in turn attached to or pressed against the membrane.

The cathode should be resistant to corrosion by the catholyte, resistant to erosion, and preferably will contain an electrocatalyst to minimize hydrogen overvoltage. The cathode may be, e.g., mild steel, nickel, or stainless steel, and the electrocatalyst may be platinum black, palladium, gold, spinels, manganese, cobalt, nickel, Raney nickel, reduced platinum group metal oxides, alpha-iron, or the like.

The cathode may be a "zero-gap" cathode, against which the membrane is urged and which cathode is permeable to both liquids and gases. The cathode may be kept a small distance from the membrane by the use of a spacer, against which the membrane is urged by a small hydraulic head on the other side of the membrane. In the case of a three-compartment cell, both membranes may be urged against electrodes or spacers by a hydraulic head on the center compartment. The spacer may be made of a plastic which is resistant to the chemicals in the catholyte, such as polytetrafluoroethylene, ethylene/tetrafluoroethylene resin, or polychlorotrifluoroethylene. It is desirable that the cathode spacer or electrode have open vertical channels or grooves to facilitate the escape of gas evolved at the cathode. Whether or not there is a spacer, it may be desirable to have the cathode openings slanted so the gas is carried away from the membrane and catholyte flow past the membrane is maximized. This effect may be augmented by using downcomers for catholyte which has been lifted by rising gas bubbles. The cathode may be a porous cathode, pressed against the membrane or pressed against a porous layer, which is in turn attached to or pressed against the membrane.

An oxygen cathode can be used, in which oxygen is supplied to the cathode and substantially no hydrogen is evolved, with lower cell voltage as a result. The oxygen may be supplied either by bubbling through the catholyte and against the cathode, or by feeding oxygen-containing gas through a porous inlet tube which also serves as cathode and is coated with electrocatalyst.

Because a bimembrane or multi-layer membrane containing one or more sulfonate layers has lower electrical resistance than an all-carboxylate membrane, it can be operated at lower voltage or higher current density. Good results can be obtained at 2–5 kA/m$^2$, preferably 3–4 kA/m$^2$.

While membrane cells are frequently operated at approximately atmospheric pressure, there can be advantages to operating them at elevated pressure.

It should be noted that reduction in cell voltage is not achieved when the cathode surface of the membrane is coated with an effective gas- and liquid-permeable porous non-electrode layer. Such non-electrode layer can be in the form of a thin hydrophilic coating and is ordinarily of an inert electroinactive or non-electrocatalytic substance. A non-electrode layer ordinarily comprises an inorganic component and a binder; the inorganic component can be an inorganic compound which is chemically stable in hot concentrated caustic and chlorine, preferably tin oxide, titanium oxide, silicon carbide, or zirconium oxide.

EXAMPLES

Example 1

About 1 liter of an aqueous/alcoholic (50–100:1) solution containing about 500 ppm perfluoro ionomer resin which is made from a polymer with a side chain of $$-(CF_2\underset{\underset{CF_3}{|}}{C}FO)-CF_2-CF_2-SO_2F$$

in manner described in U.S. Pat. Nos. 4,433,082 and 4,453,991 (known as Nafion® and produced by E. I. du Pont de Nemours and Company) was added to the catholyte dilution water of a chloralkali electrolyzer which had been operating for one day. The membrane is fabricated as follows: A first copolymer of 58.7% by weight of tetrafluoroethylene and 41.3% by weight of perfluoro(3,6-dioxa-4-methyl-7-octenesulfonyl fluoride) which was prepared according to the procedure of U.S. Pat. No. 3,282,875. A second copolymer of 59.8% by weight of tetrafluoroethylene and 40.2% by weight of $$CF_2=CF-O-CF_2-\underset{\underset{CF_3}{|}}{C}F-O-CF_2-CF_2-COOCH_3$$

was also prepared. A reinforcing fabric was woven from poly(tetrafluoroethylene) fibers and polyethylene terephthalate fibers. A membrane was made by laminating a structure made up of 1 ) a 25 millimicron film of the first polymer, 2) the reinforcing fabric, 3) a 100 millimicron film of the first polymer, 4) a 40 millimicron film of the second polymer.

The membrane is hydrolyzed by treating it with aqueous caustic solution. Solvents can also be added to accelerate the reaction. Dimethylsulfoxide is an example of such a solvent.

The layer made from the second polymer contacts catholyte in the electrolytic cell. A commercial membrane was installed in a chloralkali cell. The chloralkali cell was operating at the following conditions:

3.1 kA/m$^2$, 90° C. 32% NaOH, 200 g/l Anolyte

FIG. 1 shows the change in voltage in hours. Table 1 summarizes the performance of the electrolyzer.

TABLE 1

| Day | Voltage @ 32% NaOH | % Current Efficiency | kWhr/mT Power Consumption |
|---|---|---|---|
| 1 | 3.517 | 96.21 | 2449 |
| | Addition of fluorocarbon ionomer | | |
| 2 | 3.423 | 96.26 | 2383 |
| 3 | 3.437 | 97.15 | 2370 |
| 4 | 3.452 | 95.61 | 2419 |

Example 2

An electrolyzer in which the perfluoro ionomer membrane described in Example 1 was installed and was operated at the following conditions:

3 kA/m$^2$, 90° C., 32% NaOH

An aqueous/alcoholic solution (50–100:1) containing approximately 800 ppm of the fluorocarbon ionomer described in Example 1 was metered over about 100 minutes into the catholyte dilution water. The voltage was reduced to 3.323, a net reduction of 80 mV.

Figure 2:
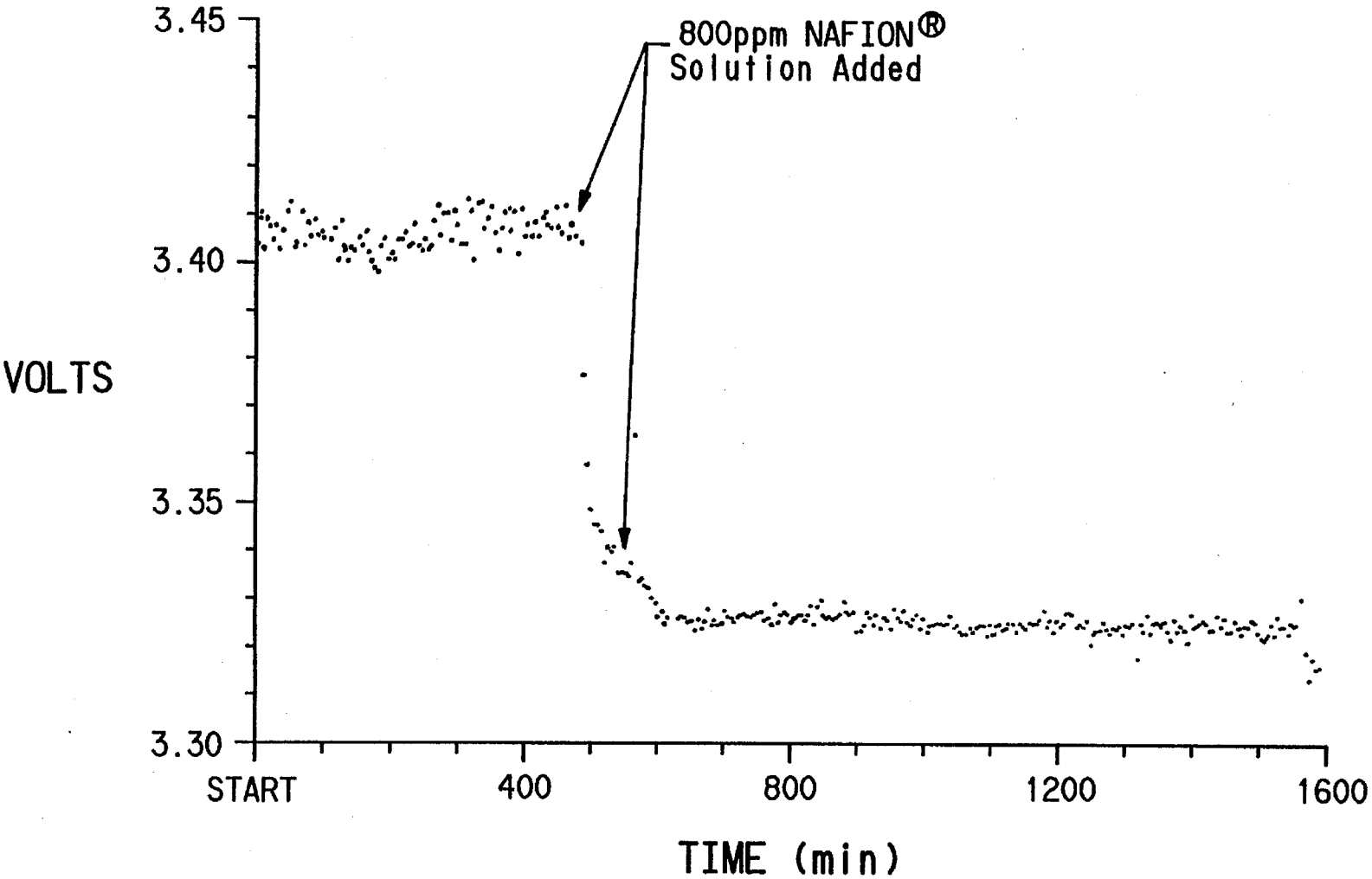
Figure 3:
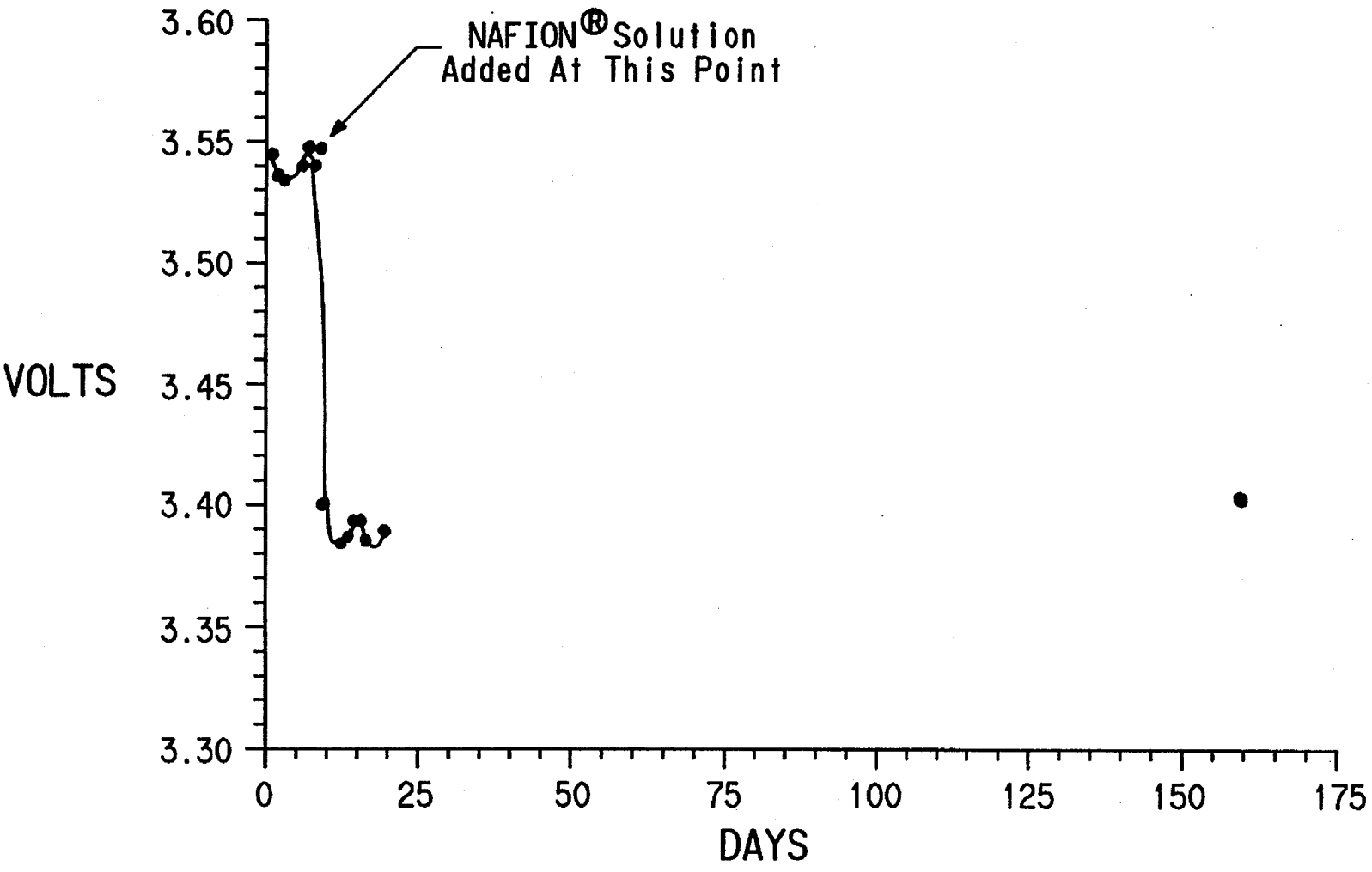
FIG. 3 plots cell voltage in volts vs. time showing that the voltage reduction is sustained even after restarting the electrolytic cell.

Table 2 summarizes the results of cell operation before and after the addition of the fluorocarbon ionomer. FIG. 2 shows the change in voltage.

TABLE 2

| Day | Voltage @ 32% NaOH | % Current Efficiency | kWhr/mT Power Consumption |
|---|---|---|---|
| 1 | 3.394 | 96.93 | 2346 |
| 2 | 3.404 | 96.11 | 2373 |
| | Addition of fluorocarbon ionomer | | |
| 3 | 3.324 | 95.24 | 2338 |
| 4 | 3.321 | 95.52 | 2329 |

Example 3

This Example demonstrates the persistence of the voltage reduction for the fluorocarbon ionomer described in Example 1 added to the catholyte compartment of an electrolytic cell. An electrolyzer in which an unreinforced membrane composed of films of 25–35 micrometer thick carboxylate fluorocarbon ionomer and 100 micrometer thick sulfonate fluorocarbon ionomer was installed with the carboxyl layer facing the catholyte compartment. The operating conditions were 3 kA/$m^2$, 90° C., 32% NaOH.

Voltage was 3.54–3.55. After addition of an aqueous/alcoholic solution containing approximately 500 ppm fluorocarbon ionomer to the catholyte dilution water, the voltage was reduced to 3.38–3.40, a net reduction of 140–170 mV.

The electrolyzer was shut down and the membrane rinsed, removed, dried, and stored. After about 130 days storage, the membrane was prepared for reinstallation in the electrolyzer by soaking in 2% aqueous sodium hydroxide. Ten days later, the membrane was installed and the electrolyzer restarted. The voltage was 3.40. The voltage benefit of the fluorocarbon ionomer treatment was retained during the extended dry storage period and the approximately ten-day soaking before reinstallation.

I claim:

1. In a process for the electrolysis of a solution in an electrolytic cell which comprises an anode, a cathode, an anode compartment, a cathode compartment, and a fluorine-containing ion exchange membrane which separates said compartments, where the improvement comprises adding fluorinated ionomer resin to said cathode compartment.

2. The process of claim 1 wherein said fluorinated ionomer resin is a fluorinated sulfonyl resin.

3. The process of claim 2 wherein said fluorinated ionomer resin contains the group —$CF_2CFR'SO_2X$, where R' is F, Cl, $CF_2Cl$ or a $C_1$ to $C_{10}$ perfluoroalkyl radical, and X is F or Cl.

4. The process of claim 1 in which the solution is an alkali metal salt solution.

5. The process of claim 4 in which the alkali metal salt solution is brine.

6. The process of claim 1 in which the fluorinated ionomer resin is introduced in the cathode compartment as a 0.001–1% by weight solution in an amount of about 10–1000 ml per square meter of ion exchange membrane.

7. The process for electrolysis of a solution in an electrolytic cell which comprises an anode, a cathode, an anode compartment containing an anolyte, a cathode compartment containing a catholyte, and a fluorine-containing ion exchange membrane which separates said compartments, comprising adding to the catholyte sufficient amounts of a fluorinated ionomer resin to reduce cell voltage.

8. The process of claim 7 wherein said fluorinated ionomer resin is a fluorinated sulfonyl resin.

9. The process of claim 8 wherein said fluorinated ionomer resin contains the group —$CF_2CFR'SO_2X$, where R' is F, Cl $CF_2Cl$ or a $C_1$ to $C_{10}$ perfluoroalkyl radical, and X is F or Cl.

10. The process of claim 7 in which the solution is an alkali metal salt solution.

11. The process of claim 10 in which the fluorinated ionomer resin is introduced in the cathode compartment as a 0.001–1% by weight solution in an amount of about 10–1000 ml per square meter of ion exchange membrane.

* * * * *